US008197162B2

(12) United States Patent
Sim et al.

(10) Patent No.: US 8,197,162 B2
(45) Date of Patent: Jun. 12, 2012

(54) METHOD AND SYSTEM FOR MAKING HOLES IN COMPOSITE MATERIALS

(75) Inventors: Wei Ming Sim, Bristol (GB); Martin Stalley, Bristol (GB)

(73) Assignee: Airbus Operations Limited, Bristol (GB)

( * ) Notice: Subject to any disclaimer, the term of this patent is extended or adjusted under 35 U.S.C. 154(b) by 1202 days.

(21) Appl. No.: 11/987,462

(22) Filed: Nov. 30, 2007

(65) Prior Publication Data

US 2008/0141517 A1 Jun. 19, 2008

(30) Foreign Application Priority Data

Dec. 19, 2006 (GB) ..... 0625301.7

(51) Int. Cl.
*B23B 35/00* (2006.01)
*B23B 41/00* (2006.01)

(52) U.S. Cl. ..... 408/1 R; 408/17; 451/165

(58) Field of Classification Search ..... 408/1 R, 408/17, 124, 129, 145; 451/165; 125/3–5; 175/56

See application file for complete search history.

(56) References Cited

U.S. PATENT DOCUMENTS

| | | | | | |
|---|---|---|---|---|---|
| 3,561,462 | A | * | 2/1971 | Jugler | 173/199 |
| 3,608,648 | A | * | 9/1971 | Dibble et al. | 173/199 |
| 3,614,484 | A | * | 10/1971 | Shoh | 310/325 |
| 3,619,671 | A | * | 11/1971 | Shoh | 310/325 |
| 3,837,121 | A | * | 9/1974 | Schirmer | 451/160 |
| 4,688,970 | A | * | 8/1987 | Eckman | 408/9 |
| 4,745,557 | A | * | 5/1988 | Pekar et al. | 700/188 |
| 4,779,204 | A | * | 10/1988 | Kanematsu et al. | 700/190 |
| 4,828,052 | A | | 5/1989 | Duran et al. | |
| 4,985,841 | A | * | 1/1991 | Iwagaya | 700/191 |
| 5,140,773 | A | * | 8/1992 | Miwa et al. | 451/41 |
| 5,144,771 | A | * | 9/1992 | Miwa | 451/165 |
| 6,948,574 | B2 | | 9/2005 | Cramer et al. | |
| 2003/0001456 | A1 | | 1/2003 | Kauf et al. | |
| 2006/0006002 | A1 | | 1/2006 | Mugg et al. | |

FOREIGN PATENT DOCUMENTS

| | | | | |
|---|---|---|---|---|
| GB | 2 218 374 | | | 11/1989 |
| JP | 53091480 | A | * | 8/1978 |
| JP | 01205907 | A | * | 8/1989 |
| JP | 03293976 | A | * | 12/1991 |

OTHER PUBLICATIONS

Search Report for Great Britain Application No. 0625301.7 completed Apr. 27, 2007.

* cited by examiner

*Primary Examiner* — Daniel Howell
(74) *Attorney, Agent, or Firm* — Nixon & Vanderhye P.C.

(57) ABSTRACT

A method of making a hole in a composite material comprising the steps of providing an elongate cutting tool having a cutting portion in the form of a tubular cylinder; and advancing the cutting tool in a direction parallel to a longitudinal axis of the cutting tool whilst rotating the cutting tool about said axis and vibrating the cutting tool along said axis.

10 Claims, 1 Drawing Sheet

METHOD AND SYSTEM FOR MAKING HOLES IN COMPOSITE MATERIALS

Figure 1:
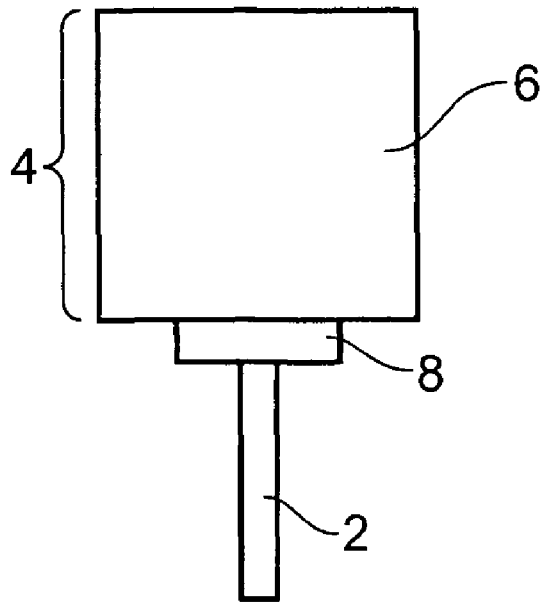

The present invention is intended primarily, but not exclusively, for application in the field technology of aircraft construction in which composite materials and laminated composite materials are widely used.

It is known in the general prior art to use solid carbide drill bits or solid carbide coated with brazed polycrystalline diamond (PCD) drill bits when drilling holes in composite materials. These drill bits generally have two cutting edges to drill through the composite materials. When drilling through metallic materials, such as aluminium or titanium alloys, these drill bits generate metal chippings. Therefore, when drilling a laminated composite material formed of multiple layers of both metallic materials and non-metallic composites, such as carbon fibre composite or glass fibre composite, it is generally considered necessary to use a "back-drilling" technique that involves advancing and retracting the drill bit in a cyclical manner after each of the metal-alloy layers has been drilled so as to remove the metal chippings formed from the drill bit so as to not damage the subsequent composite layers. Otherwise, if the drill bit is advanced continuously to drill several success metal layers, the metal chippings tend to erode the composite layers and the sealant layers, the sealant generally being a resin that is applied to the composite layers to improve the sealed joint with the adjacent metal-alloy layers. A series of forward drillings and retractions to discharge the chippings is therefore necessary until a through-hole is completed. Even when drilling structures including only composite materials it is difficult to produce through-holes without causing hole entry and exit damage, and in particular hole exit delamination due to the relatively large cutting forces required. These difficulties are magnified when drilling relatively large diameter holes, for example of the order of 20-30 mm diameter, through thick composite structures.

The present invention is therefore concerned with providing improved drilling techniques to reduce the above-identified difficulties.

According to a first aspect of the present invention there is provided a method of making a hole in a composite material comprising the steps of providing an elongate cutting tool having a cutting portion in the form of a tubular cylinder and advancing the cutting tool in a direction parallel to a longitudinal axis of the cutting tool whilst rotating the cutting tool about said axis and vibrating the cutting tool along said axis.

Preferably, the frequency of vibration applied to the cutting tool is in the range of 18 KHz to 24 KHz and more preferably is approximately 20 KHz.

Additionally or alternatively, the cutting tool may be advanced at a feed rate of up to 100 mm per minute.

In preferred embodiments the speed of rotation of the cutting tool may be no greater than 3400 rpm.

Additionally or alternatively, the cutting tool may be advanced at a first feed rate over an initial and a final portion of the hole and is advanced at a second feed rate over an intermediate portion of the hole, the second feed rate being greater than the first feed rate.

Additionally or alternatively, the cutting tool may be retracted by a first distance for every second distance the cutting tool is advanced. For example, the cutting tool may be retracted by 0.5 mm for every 1 mm advanced.

In preferred embodiments, at least a portion of the cutting tool may be coated with an abrasive grit, such as diamond grit.

According to a further aspect of the present invention there is provided a method of drilling carbon fibre composite material according to the first aspect of the present invention.

According to a third aspect of the present invention there is provided a drilling system for making a hole in a composite material comprising an elongate cutting tool having a cutting portion comprising a tubular cylinder and a drive mechanism arrived to simultaneously rotate the cutting tool about a longitudinal axis of the cutting tool, vibrate the cutting tool along the axis and advance the cutting tool in a direction parallel to the axis.

Figure 2:
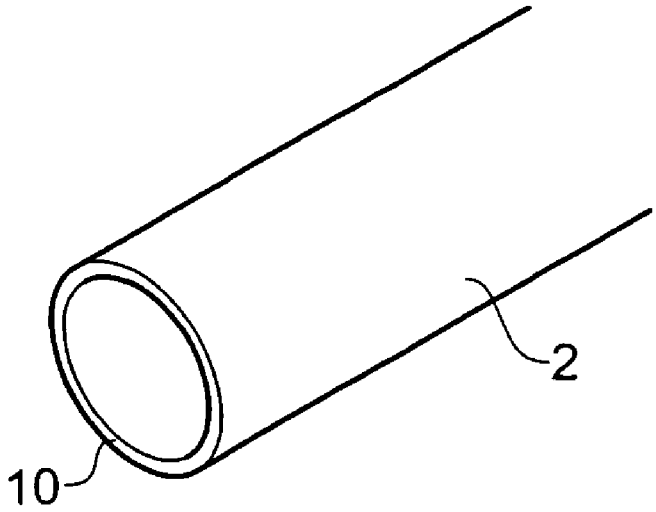

Embodiments of the present invention will now be described, by way of non-limiting example only, with reference to the accompanying figures, of which:

FIG. 1 schematically illustrates drilling apparatus for use in accordance with embodiments of the present invention; and FIG. 2 schematically illustrates an end section of a hollow drill bit for use in embodiments of the present invention.

FIG. 1 schematically illustrates the main physical elements for use in embodiments of the present invention. A drill bit 2 is provided that in use is mounted to an ultrasonically assisted drilling machine 4, which comprises a motor 6 for rotating the drill bit about its rotational axis and an ultrasonic actuator 8 that causes the drill bit to be vibrated along its longitudinal axis. An electronic control mechanism is preferably provided (not shown) for controlling the frequency of vibration, speed of rotation and advancement of the drill bit. Ultrasonic drilling machines are well known in the prior art and are commercially available and will therefore not be discussed in further detail herein.

FIG. 2 illustrates a perspective view of the cutting portion of the drill bit 2. The cutting portion is formed as an open hollow tube, with the diameter of the internal cavity bounded by the side walls being a significant portion of the overall diameter of the drill bit itself. As will be appreciated, the overall diameter of the drill bit will vary according to the required size of the hole to be formed. For example, the overall diameter of the drill bit may be approximately 25 mm, with a wall thickness of approximately 1 mm. The end surface 10 of the drill bit is coated with an abrasive material preferably having a particle size of less than 100 microns, such as diamond grit, that in use acts as a multi-teeth cutting tool to cut around the circumference of the desired hole.

To perform a drilling operation in accordance with embodiments of the present invention the hollow drill bit is both rotated about its central axis and also vibrated along its longitudinal axis, by means of the ultrasonic actuator. The ultrasonic vibration is induced on the tool at a frequency, for example, of between 18 KHz and 24 KHz and with an amplitude of up to 50 μm. In preferred embodiments a vibration frequency of 20 KHz and amplitude of 30 μm is used. The drill bit is advanced with a feed rate of, for example, between 10-100 mm per minute. In preferred embodiments the drill bit is operated with a "hiccup" cycle in which the drill bit is retracted a certain distance for every given distance of feed. For example, the drill bit may be retracted by 0.5 mm after every 1 mm of drilling. It is also preferable to flood the working area with a liquid coolant.

The ultrasonic vibration of the drill bit tends to aid dust evacuation during the cutting process and inhibits the adhesion of the composite material to the drill. The adherence of material to the drill bit is a particular problem with carbon fibre composite materials when conventional drilling techniques are used. Furthermore, because of the hollow structure of the drill bit a solid core of material is extracted from the drilled hole, thus again minimising the creation of air borne dust. Additional benefits of the ultrasonic drilling regime include a significant reduction of the drilling forces transmitted from the drill bit to the work piece and also a significant reduction in the thermal stress generated since a permanent gap is maintained between the tool and the work piece, which is only closed due to the vibrational movement of the drill bit. This reduction in the cutting forces and thermal stresses have the beneficial effects of extending the work life of the drill bit and reducing the forces experienced by the work piece. This is a significant advantage when drilling composite materials as the drilling forces that tend to cause delamination of the composite structure are greatly reduced such that delamination is effectively eliminated.

In tests in which a 25.4 mm hollow drill was used to drill holes in a carbon fibre reinforced plastic (CFRP) stack 75 mm deep the following operating parameters were found to produce clean holes with minimal entry and exit damage and no or minimal exit delamination:

| Spindle Speed (rpm) | Feed Rate (mm per minute) | $C_p$ | $P_p$ |
|---|---|---|---|
| 1700 | 10 | 1.54 | 1.14 |
| 1700 | 50 | 1.83 | 1.60 |
| 3400 | 100 | 2.08 | 2.16 |

In all cases a hiccup cycle of 1 mm feed and 0.5 mm retract was used. Additionally, the 75 mm deep holes were drilled in three stages, with the first and last two millimeters of depth of the work piece being drilled at a low feed rate of 10 mm per minute, whilst the intermediate (71 mm of depth) was drilled at the feed rate indicated above. As also indicated, excellent $C_p$ and $P_p$ index values were achieved. (The $C_p$ index is a measure of Process Capability and is expressed as a ratio of the tolerance (permitted variation) to the process variation. The $P_p$ index is a measure of the Process Performance and is expressed as a ratio of the tolerance to the variation in a sample).

The combination of a diamond coated hollow drill with an ultrasonically equipped drilling mechanism operated within the indicated parameters enables relatively large diameter holes to be drilled in composite materials and laminated composite materials with high accuracy and minimal damage or delamination of the composite work piece.

The invention claimed is:

1. A method of drilling a hole in a composite material comprising the steps of:

providing an elongate cutting tool having a cutting portion in the form of a tubular cylinder; and advancing the cutting tool in a direction parallel to a longitudinal axis of the cutting tool whilst rotating the cutting tool about said axis and vibrating the cutting tool along said axis, wherein the cutting tool is advanced at a first feed rate over an initial and a final portion of the drilling of said hole and is advanced at a second feed rate over an intermediate portion of the drilling of said hole, the second feed rate being greater than the first feed rate.

2. The method of claim 1, wherein the frequency of the vibration applied to the cutting tool is in the range of 18 KHz to 24 KHz.

3. The method of claim 1, wherein the cutting tool is advanced at a feed rate of up to 100 mm/min.

4. The method of claim 1, wherein the speed of rotation of the cutting tool is no greater than 3400 rpm.

5. The method of claim 1, wherein the cutting tool is retracted by a first distance for every second distance the cutting tool is advanced.

6. The method of claim 5, wherein the cutting tool is retracted by 0.5 mm for every 1 mm advanced.

7. The method of claim 1, wherein at least a portion of the cutting tool is coated with an abrasive grit.

8. The method of claim 7, wherein the abrasive grit comprises diamond grit.

9. A method of drilling carbon fibre composite material according to the method of claim 1.

10. A drilling system for making a hole in a composite material comprising:

a elongate cutting tool having a cutting portion comprising a tubular cylinder; and a drive mechanism configured to simultaneously rotate the cutting tool about a longitudinal axis of the cutting tool and vibrate the cutting tool along said axis; and configured to advance the cutting tool in a direction parallel to the axis at a first feed rate over an initial and a final portion of the drilling of said hole and is advanced at a second feed rate over an intermediate portion of the drilling of said hole, the second feed rate being greater than the first feed rate.

* * * * *